US006553785B2

(12) United States Patent
Mount

(10) Patent No.: US 6,553,785 B2
(45) Date of Patent: Apr. 29, 2003

(54) JEWELRY CHAIN WITH REMOVABLE DECORATIVE PIECES

(76) Inventor: Michael D. Mount, 660 N. Gardner, Scottsburg, IN (US) 47170

( * ) Notice: Subject to any disclaimer, the term of this patent is extended or adjusted under 35 U.S.C. 154(b) by 0 days.

(21) Appl. No.: 09/795,408

(22) Filed: Feb. 28, 2001

(65) Prior Publication Data

US 2002/0116947 A1 Aug. 29, 2002

(51) Int. Cl.[7] ..... A33C 5/00

(52) U.S. Cl. ..... 63/3; 63/1.11; 63/1.16; 63/3.1; 63/3.2; 63/23; 63/26; 63/29.1; 63/31

(58) Field of Search ..... 63/1.11, 1.16, 63/3, 3.1, 3.2, 4, 11, 21, 23, 26, 29.1, 31

(56) References Cited

U.S. PATENT DOCUMENTS 2,629,981 A * 3/1953 Melik-Minassiantz ..... 368/281
2,653,402 A * 9/1953 Bonagura ..... 40/662
3,340,630 A * 9/1967 Becker ..... 40/633
3,345,830 A 10/1967 Fontaine
4,305,262 A * 12/1981 Ferrara ..... 63/29.1
4,542,630 A * 9/1985 Nanasi et al. ..... 63/3
4,551,993 A * 11/1985 Nagahori ..... 63/31
4,783,974 A 11/1988 Hernandez
4,879,882 A * 11/1989 Johnson et al. ..... 63/4
5,138,855 A * 8/1992 Faris ..... 70/457
5,170,643 A 12/1992 Porcell, Jr.
5,367,891 A 11/1994 Furuyama
5,528,909 A 6/1996 Tonakawa
5,606,874 A * 3/1997 Archetti et al. ..... 63/21
5,816,072 A 10/1998 Michaels
5,836,176 A 11/1998 Lichtenstein et al.
5,896,757 A * 4/1999 Kharloubian ..... 63/31
6,112,373 A * 9/2000 Steinhauer et al. ..... 24/68 J
6,349,568 B1 * 2/2002 Ito ..... 63/3

* cited by examiner

*Primary Examiner*—J. J. Swann
*Assistant Examiner*—Andrea Chop
(74) *Attorney, Agent, or Firm*—Carrithers Law Office; David W. Carrithers

(57) ABSTRACT

A jewelry piece that includes a chain or necklace with one or more decorative jewelry pieces removably mounted thereon by way of a narrow necked down minor length portion of the necklace adjacent the necklace clasp. The decorative jewelry pieces have an open ended channel in the rear face thereof slidably receiving therein the necklace. A gap in the channel is wider than the narrow necked down portion but narrower than the remainder of the necklace.

14 Claims, 2 Drawing Sheets

JEWELRY CHAIN WITH REMOVABLE DECORATIVE PIECES

TECHNICAL FIELD

This invention relates generally to jewelry and more particularly to a flexible chain of substantially constant cross-sectional outline throughout a major portion of the length thereof and having a narrower necked down area and at least one decorative piece slidable along and retained on the chain and which can be placed on or removed from the chain at said necked down area.

BACKGROUND INFORMATION

The amount of jewelry worn can vary considerably from one function to another depending upon the occasion and/or mood of the individual wearing the jewelry. To satisfy this it is desirable to have a basic piece of jewelry that decorative pieces can be easily added to and removed from as desired without fear of accidental removal of the added pieces.

It is known in the prior art to have a basic jewelry piece and add thereto decorative pieces as desired and by way of example reference maybe had to U.S. Pat. No. 5,816,072 granted Oct. 6, 1998 to T. Michaels. Disclosed therein is a band bracelet with decorative pieces that have a pair of projections defining prongs or lugs and can be slid onto the band from an end or the band may be wedged inbetween the prongs using a twisting motion. The pieces can slide on or off from either of the two ends of the band and thus the patentee discloses utilizing some means to anchor the decorative pieces to the band at the desired location on the band.

SUMMARY OF INVENTION

The present invention comprises a means of mounting a jewelry piece on a flexible member such as a chain with one or more decorative jewelry pieces having a pair of spaced apart prongs extending therefrom for removably mounting on the chain by way of a narrow necked down minor length portion of the chain preferably adjacent the clasp. Of course, the narrow portion could be located on any position of the chain or the clasp as well, just so that there is a neck having a reduced width between adjoining wider portions of the chain, necklace, or clasp or other means of attachment. By locating the neck adjacent the clasp, decorative mountings can be added or removed by the wearer even without having to disconnect the clasp. The decorative jewelry pieces have an open ended channel in the rear face thereof slidably receiving therein the necklace. A gap in the channel is wider than the narrow necked down portion but narrower than the remainder of the necklace.

More particularly, in accordance with the present invention there is provided a jewelry piece comprising a length of flexible chain having detachably interconnectable clasp portions. The clasp portions permit changing the chain from one state to another. It may be worn as a single discrete length or alternately worn in an endless loop. The chain has a necked down narrow portion proximate the clasp with the remainder being of a substantially constant cross-sectional outline dimension throughout its length. At least one ornamental piece having a front decorative face and a rear face, and a pair of spaced apart prongs projecting from the rear face define a channel slidably receiving therein the chain length portion of a constant cross-sectional dimension. The prongs have a space thereinbetween greater than the width of the necked down chain portion but less than the width of the remainder of the chain length.

The instant invention may also define a jewelry piece, having a first flexible member having a discrete length and including co-operating inter-connectable clasp portions on opposite ends thereof. A major length portion of the first member is of substantially constant cross-sectional outline and a minor length portion, proximate one of the clasp portions is or reduced width being necked down providing a cross-sectional outline smaller than that of the the major length portion. A second decorative jewelry piece is mounted thereto. The second decorative jewelry piece has a front face and a rear face, and an open ended channel on the rear face. The channel extends in a direction there across and slidably receiving therein the first member. An opening into the channel that is narrower in width than the channel and wider than the necked down portion of the first member permits removably mounting the decorative second member on the first flexible member.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
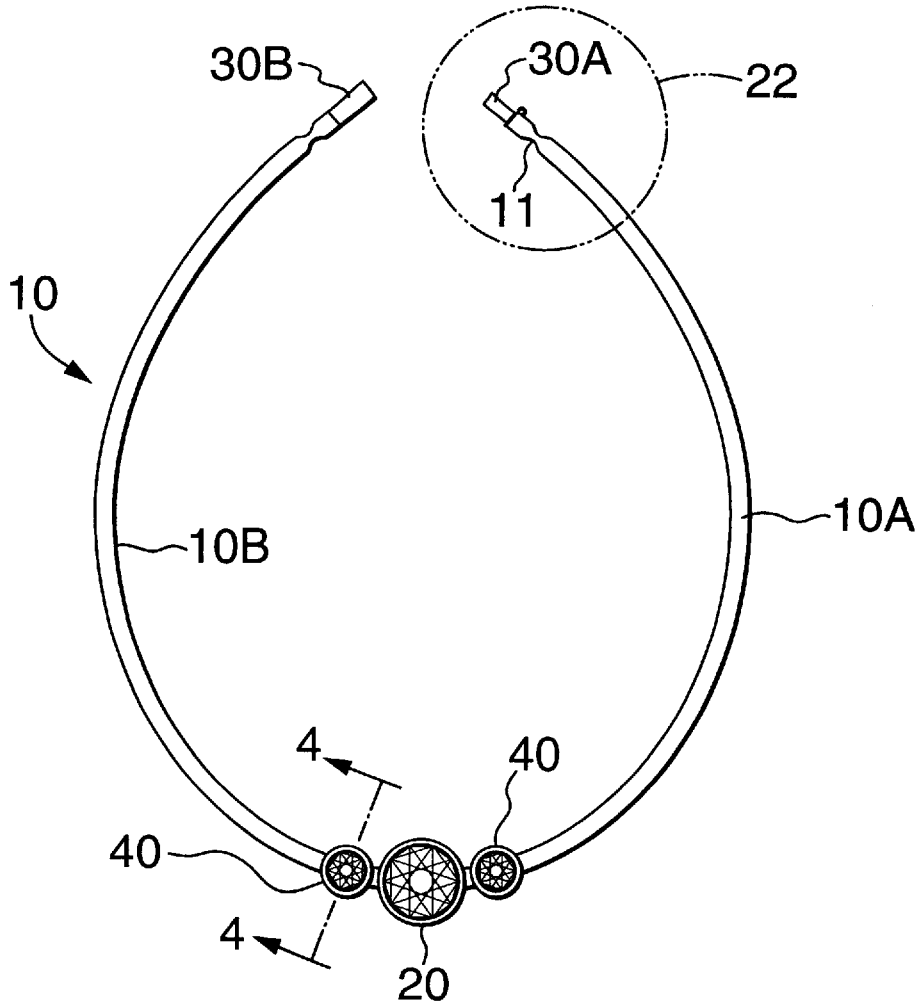
FIG. 1 is a front view of a piece of jewelry provided in accordance with the present invention.
Figure 2:
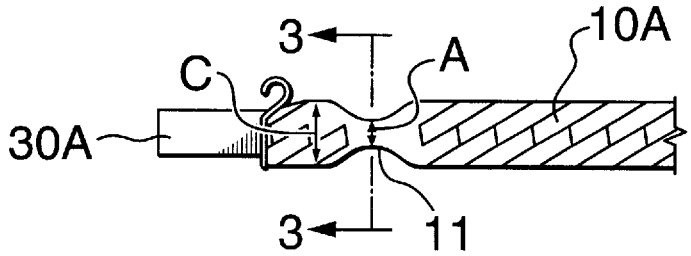
FIG. 2 is a view of the encircled portion designated 2 in FIG. 1 but on a larger scale.
Figure 3:
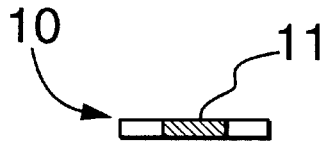
FIG. 3 is a sectional view taken along line 3—3 of FIG. 2.
Figure 4:
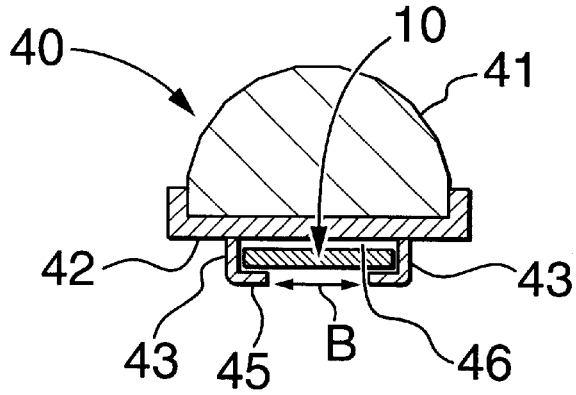
FIG. 4 is a sectional view taken along line 4—4 of FIG. 1.

Illustrated in FIGS. 1 to 4 is a piece of jewelry commonly known as a necklace and comprises a length of flexible chain 10 having co-operating detachably inter-connectable clasp portions 30A and 30B at opposite ends thereof. The clasp portions permit changing the chain length from one state to the other. In one state the chain is of a discrete length and in the other state the chain is in an endless loop.

The chain in a preferred embodiment is made of metal in the well known herring bone weave rendering it flexible and while illustrated as being rectangular in outline cross-sectional shape it could be round, elliptical or of other shape. Of course, the chain can be composed of plastic or other material and be fabricated of multiple links, loops, a continuous strand, or any other selected weave. The chain in the preferred embodiment however is of substantially constant cross-sectional outline size throughout the length thereof except for a minor length portion 11 proximate the clasp where it is necked down to be of narrower width than the remainder of the chain. Of course the dimension of the chain is of no importance other than that the body being greater than in width than the neck. The chain may even comprise several strands joined together at the neck.

The basic necklace can be easily and quickly modified by adding thereto one or more decorative jewelry pieces 40 which, as will be seen hereinafter, can also be used as an ear piece illustrated in FIG. 5.

The jewelry piece 40 has a front decorative face 41 and a rear face 42 that has a spaced apart pair of prongs 43 projecting therefrom. The prongs each terminate in an end portion 45 that is turned inwardly toward the other. The prongs provide an open channel 46 that slidably receives therein the chain 10. The prong terminal ends 45 are spaced apart a distance designated B. The chain necked down portion has a width designated A and the chain a width designated C. The dimension B is greater than A but less than C and this will make it obvious the decorative piece can be placed on and removed from the chain at the necked down portion 11 but elsewhere on the chain is retained thereon by the prongs.

The channel 46 is shown as being rectangular but it could readily be of other shape and preferably corresponds to the outline configuration of the chain. Entry to the channel is through the gap between the prong ends 45. The chain maybe a link type chain with the necked down narrower portion being provided for example by a few joined together links smaller in size that the remainder of the links that provide the major length portion of the chain.

Figure 6:
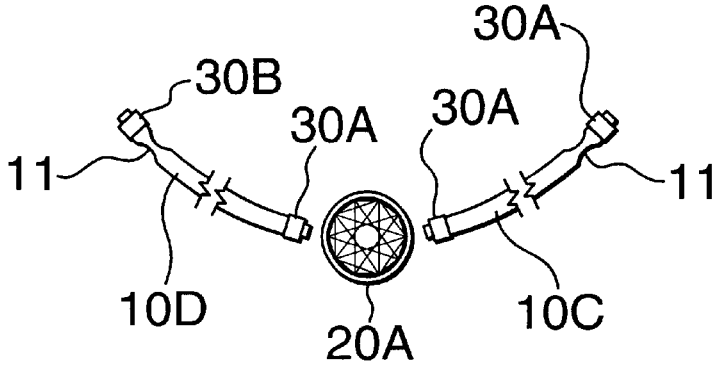
FIG. 6 is an exploded front face view of an alternative construction for the necklace.

The chain 10 is shown in FIG. 1 as comprising length portions 10A and 10B having at one end thereof respective clasp portions 30A and 30B and at the other end are connected to a decorative piece 20. In the embodiment illustrated in FIG. 1 that connection to piece 20 is permanent. In the embodiment illustrated in FIG. 6 there is a decorative center piece 20A and detachably connected thereto are respective chain length portions 10C and 10D by respective one of a pair of clasp portions 30A.

Figure 5:
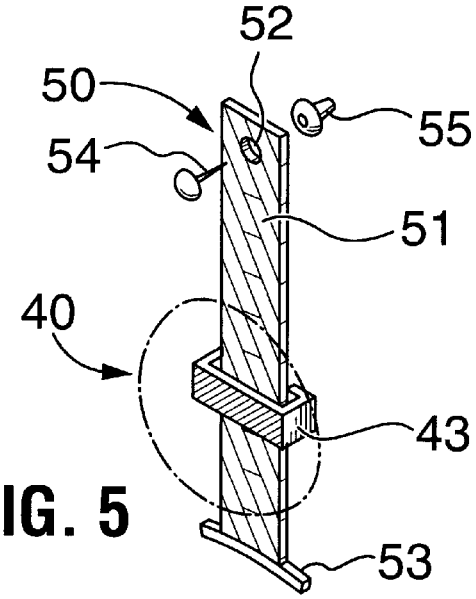
FIG. 5 is an oblique exploded view of an ear attachable piece of jewelry.

Referring to FIG. 5 there is illustrated an ear piece 50 comprising a decorative piece 40 slidably mounted on a length of chain 51 having a hole 52 proximate one end and a bar 53 at the other end serving as an abutment for the decorative piece 40. The ear piece is mounted on the ear by a conventional headed pin 54 having a detachable clasp 55.

A necklace of the present invention, in it's simplest form consists of a length of chain 10D and one decorative piece 40 slidably mounted thereon. A more elaborate piece is shown in FIG. 1 in which the chain has a center piece 20 and a decorative piece 40 slidably mounted on each of the chain portions 10A and 10B. Still more elaborate forms can have additional decorative pieces 40 slidably mounted on the chain.

The chain can be a quality piece of jewelry and the pieces 40 may be either quality pieces or costume jewelry pieces. There can be circumstances where thievery is of concern with respect to an investment in quality pieces and with the present design there can be duplicate decorative pieces 40 with one being an expensive jewelry piece and the other a fake but perhaps identifiable as such only by a jewelry expert.

The jewelry piece 40 has the channel on and extending across the rear face thereof and the front face may have surface formations on or applied thereto and/or gems and/or fake gems mounted thereon to provide the decorative face.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A jewelry piece, comprising:

a flexible member having a discrete length and including co-operating inter-connectable clasp portions on opposite ends thereof, a first segment portion of said flexible member being of substantially constant cross-sectional outline and a second segment at a selected location defining a necked down section providing a cross-sectional outline smaller than that of said first segment;

a decorative jewelry piece having a front face and a rear face, an open ended channel on said rear face, and means for slidably attaching said decorative/jewelry piece by said flexible member, said means including said open ended channel including an opening that is narrower in width than said channel and wider than said necked down section permitting removably mounting said decorative jewelry piece on said flexible member; and said necked down section enabling said decorative jewelry piece to be slidably attached or removed from said flexible member even when the clasp portions are connected together.

2. The jewelry piece as defined in claim 1 wherein said flexible member is a chain necklace.

3. The jewelry piece as defined in claim 1 including a second decorative piece secured to said flexible member and located approximately midway between said clasp portions.

4. The jewelry piece as defined in claim 3 wherein said second decorative piece is fixedly secured to said flexible member.

5. The jewelry piece as defined in claim 3 wherein said second decorative piece is detachably secured to said flexible member.

6. The jewelry piece as defined in claim 3 wherein said flexible member comprises first and second portions of substantially equal length, each said equal length portions having a clasp portion at each of opposite ends thereof with two of said ends being detachably interconnected by the clasp portions thereat and said clasp portions at the other ends of the respective equal length portions being detachably connected to said second decorative piece.

7. The jewelry section piece as defined in claim 1 wherein said necked down section on said flexible member is adjacent each of said interconnectable clasp portions.

8. The jewelry piece as defined in claim 1, wherein said means for :slidably attaching said decorative jewelry piece to said flexible member comprises at least two prongs extending from the rear face of said decorative jewelry piece.

9. The jewelry piece as defined in claim 8, wherein said at least two prongs extending from the rear face of said decorative jewelry piece have distal ends projecting inwardly toward one another.

10. The jewelry piece as defined in claim 1, wherein said means for slidably attaching said decorative jewelry piece to said flexible member includes at least two opposing flanges extending from the rear face of said decorative jewelry piece therefrom.

11. A jewelry piece, comprising:

a first flexible member having a discrete length and including co-operating inter-connectable clasp portions on opposite ends thereof, a first segment portion of said first flexible member being of substantially constant cross-sectional outline and a second segment at a selected location defining a necked down portion providing a cross-sectional outline smaller than that of said first segment portion;

a decorative jewelry piece having a front face and a rear face, said rear face including an open ended channel having an opening portion that is narrower in width than said open ended channel and wider than said necked down portion of said flexible member and means for slidably attaching said decorative jewelry piece to said flexible member through said open ended channel permitting removably mounting said decorative jewelry piece on said flexible member; and said necked down portion enabling said decorative jewelry piece to be attached or removed from said first segment portion even when said co-operating interconnectable clasp portions are connected together.

12. The jewelry piece as defined in claim 11, wherein said means for slidably attaching said decorative jewelry piece to said flexible member comprises at least two prongs extending from the rear face of said decorative jewelry piece.

13. The jewelry piece as defined in claim 12, wherein said at least two prongs extending from the rear face of said decorative jewelry piece have distal ends projecting inwardly toward one another.

14. The jewelry piece as defined in claim 11, wherein said means for slidably attaching said decorative jewelry piece to said flexible member includes at least two opposing flanges extending from the rear face of said decorative jewelry piece.

* * * * *